US007461659B2

(12) United States Patent
Glynn, Jr. et al.

(10) Patent No.: US 7,461,659 B2
(45) Date of Patent: Dec. 9, 2008

(54) WATER ABSORBING HAIR STYLING IMPLEMENT

(75) Inventors: John R. Glynn, Jr., Ridgewood, NJ (US); John S. Kurek, Goshen, NY (US); Derrick B. McKie, Brooklyn, NY (US); Shari Martin, Suffern, NY (US)

(73) Assignee: Avon Products, Inc., New York, NY (US)

( * ) Notice: Subject to any disclaimer, the term of this patent is extended or adjusted under 35 U.S.C. 154(b) by 196 days.

(21) Appl. No.: 11/248,868

(22) Filed: Oct. 12, 2005

(65) Prior Publication Data

US 2007/0079842 A1 Apr. 12, 2007

(51) Int. Cl.
*A45D 24/16* (2006.01)

(52) U.S. Cl. ..... 132/108; 132/120

(58) Field of Classification Search ..... 132/111–116, 132/120, 107–109; 401/10, 35; 15/114
See application file for complete search history.

(56) References Cited

U.S. PATENT DOCUMENTS

| | | | | |
|---|---|---|---|---|
| 633,457 | A * | 9/1899 | Hotze | 132/111 |
| 3,696,818 | A | 10/1972 | Weber | |
| 4,585,018 | A * | 4/1986 | O'Connor | 132/120 |
| 4,867,183 | A * | 9/1989 | Busch et al. | 132/110 |
| 4,877,042 | A | 10/1989 | Downey | |
| 5,077,914 | A | 1/1992 | Yamamoto | |
| 5,343,880 | A * | 9/1994 | McKay | 132/116 |
| 5,676,480 | A * | 10/1997 | Tosto | 401/10 |
| 6,062,231 | A * | 5/2000 | De Laforcade | 132/145 |

FOREIGN PATENT DOCUMENTS

| | | |
|---|---|---|
| JP | 02-243730 | 9/1990 |
| JP | 03-212208 | 9/1991 |
| JP | 04-190725 | 7/1992 |
| JP | 04-215707 | 8/1992 |
| JP | 11-151114 | 6/1999 |
| WO | WO 95/03725 A1 | 2/1995 |
| WO | WO 00/49966 A2 | 8/2000 |
| WO | WO 01/52689 A1 | 7/2001 |

* cited by examiner

*Primary Examiner*—Robyn Doan
(74) *Attorney, Agent, or Firm*—Charles S. Zeller; Joan M. McGellyruddy; Anthony M. Santini

(57) ABSTRACT

A hair styling implement is comprised of a support and an extension mounted therefrom. The extension is preferably comprised of at least 75%, more preferably 90% and most preferably is comprised substantially completely of a material able to absorb water by wicking or capillary action. The extension is coil shaped, a die-cut sheet folded to encase at least a part of the support, a plurality of disks or a first series of disks separated from a second series of disks by a plurality of bristles.

13 Claims, 6 Drawing Sheets

WATER ABSORBING HAIR STYLING IMPLEMENT

FIELD OF THE INVENTION

The present invention relates to hair styling implements such as hair brushes and combs. More particularly, it relates to hair styling implements that facilitate hair drying during styling.

BACKGROUND OF THE INVENTION

A common complaint of woman and men with long hair is that it takes too long to dry and style their hair. A hair dryer is typically employed to speed up drying, but this is often disadvantageous as high temperature drying can damage the hair. Additionally, a hair dryer is not always convenient to use. Thus, there is a need for a hair styling implement that reduces the time to style and dry hair thereby decreasing the time the hair is exposed to the heat of a hair dryer, which in turn reduces hair damage. There is also a need to provide a convenient means to dry hair that does not require a cumbersome device or a source of electric power.

Hair brushes and combs for drying and styling hair are known in the art. For example U.S. Pat. No. 4,877,042 discloses a brush for drying hair. The brush has a hollow interior and the bristles of the brush pass through a non-woven fabric sheet of water absorbent material.

Japanese 09-7362446 discloses a water-absorbing comb which can absorb water from wet hair and can also be used to apply product to the hair without staining the user's hands. The comb is comprised of a water absorbing part and a reinforcing part that clasps the water absorbing part from both sides. A reinforcing part is employed to give the comb teeth rigidity.

Japanese 04-215707A discloses a water absorbing/drying hair-brush where the bristles of the brush are embedded in a water absorbing element aggregate body.

Japanese 04-1900725A discloses a water-absorbing brush for grooming animals. The brush bristles are disposed on the side edge of an outer case in which are fitted water-absorbing elements having saw-toothed exposed ends.

Japanese 03-212208A provides a water-absorbing material of a nonwoven fabric on the surface of the tines of a brush.

Japanese 02-234730A provides a water absorbing core member made of a resin porous water absorbing core material disposed around a center shaft connected to a handle. The brush bristles extend radially from the water absorbing core member.

SUMMARY OF THE INVENTION

The present invention provides a hair styling implement, such as a brush or comb, which in one embodiment is characterized in that the bristles of the brush, or teeth of the comb are principally made of a material capable of absorbing water through wicking or capillary action.

The invention also provides a hair styling implement employing an overlay that is principally made of a material capable of absorbing water through wicking or capillary action. The overlay, which has at least one row of tooth-like projections, is removably mounted on a support having a handle.

The invention further provides a hair styling implement comprising a handle with a coil-shaped extension mounted thereon, the extension being substantially completely comprised of a material capable of absorbing water through wicking or capillary action.

DESCRIPTION OF THE DRAWING FIGURES

Embodiments of the present invention are illustrated in the accompany drawings in which.

Figure 2:
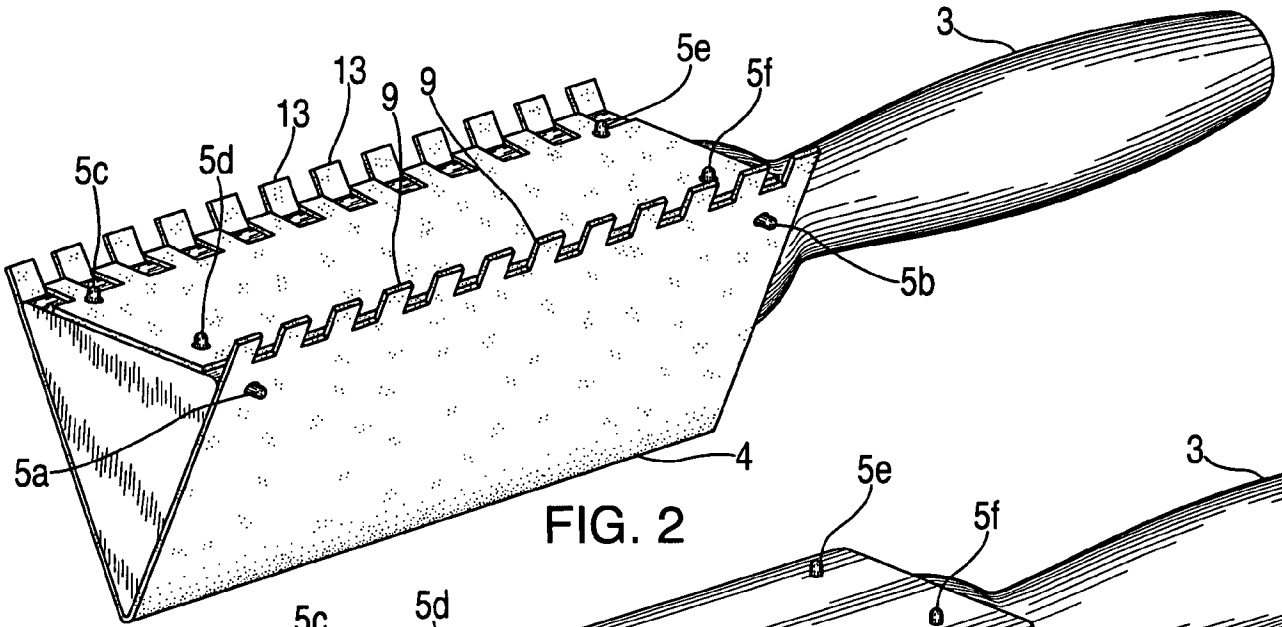
FIG. 2 is a perspective view of another embodiment of an implement in accordance with the present invention, in which the material able to absorb water is in the form of a die-cut overlay having on at least one edge a plurality of toothlike projections, the die-cut brush overlay foldably encasing a complementary shaped support having a handle.
Figure 2A:
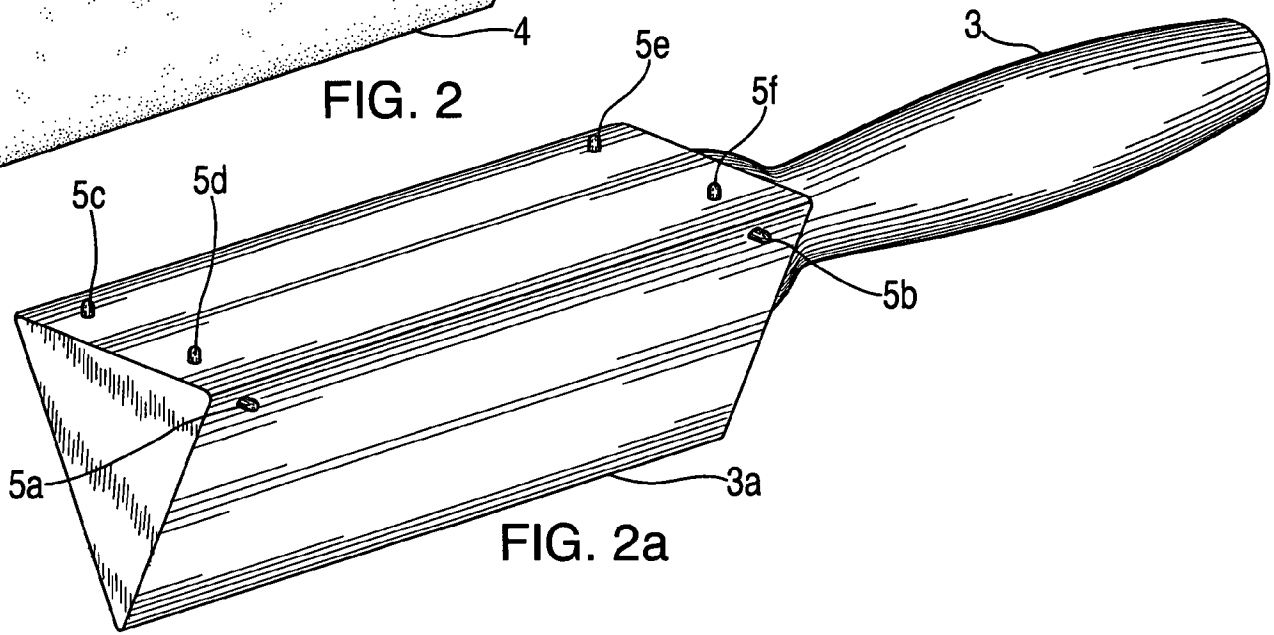
Figure 3:
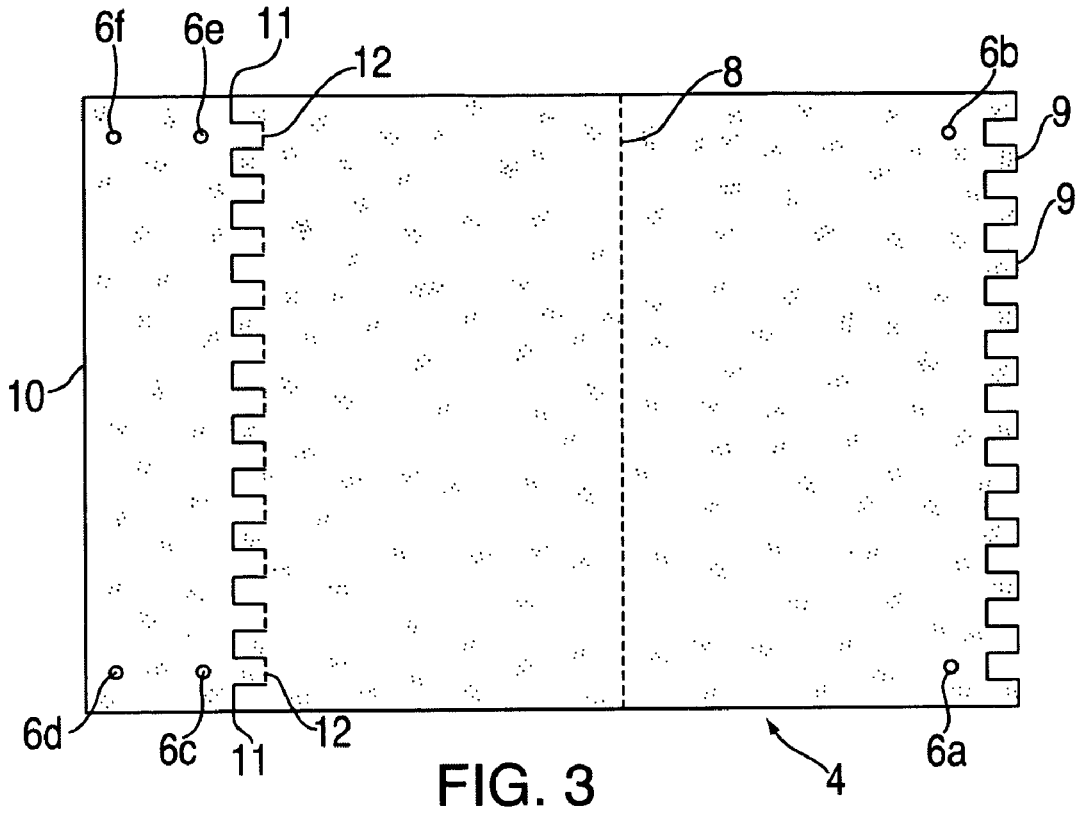
Figure 4:
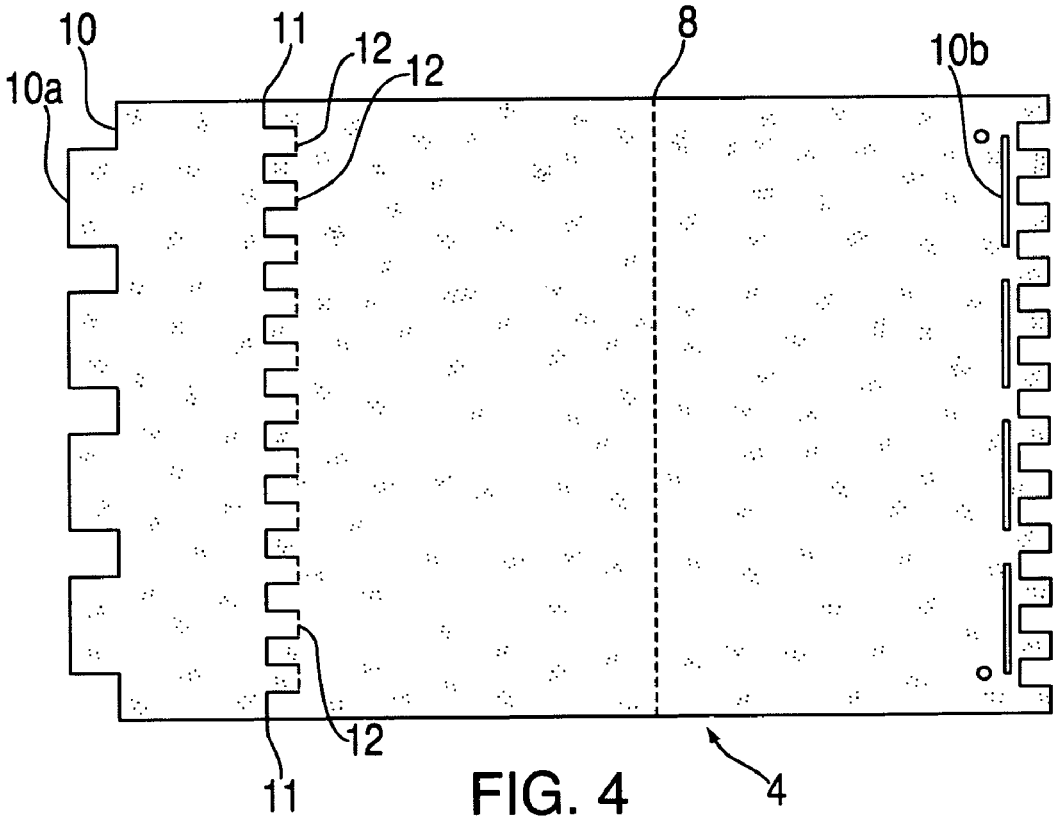
Figure 5:
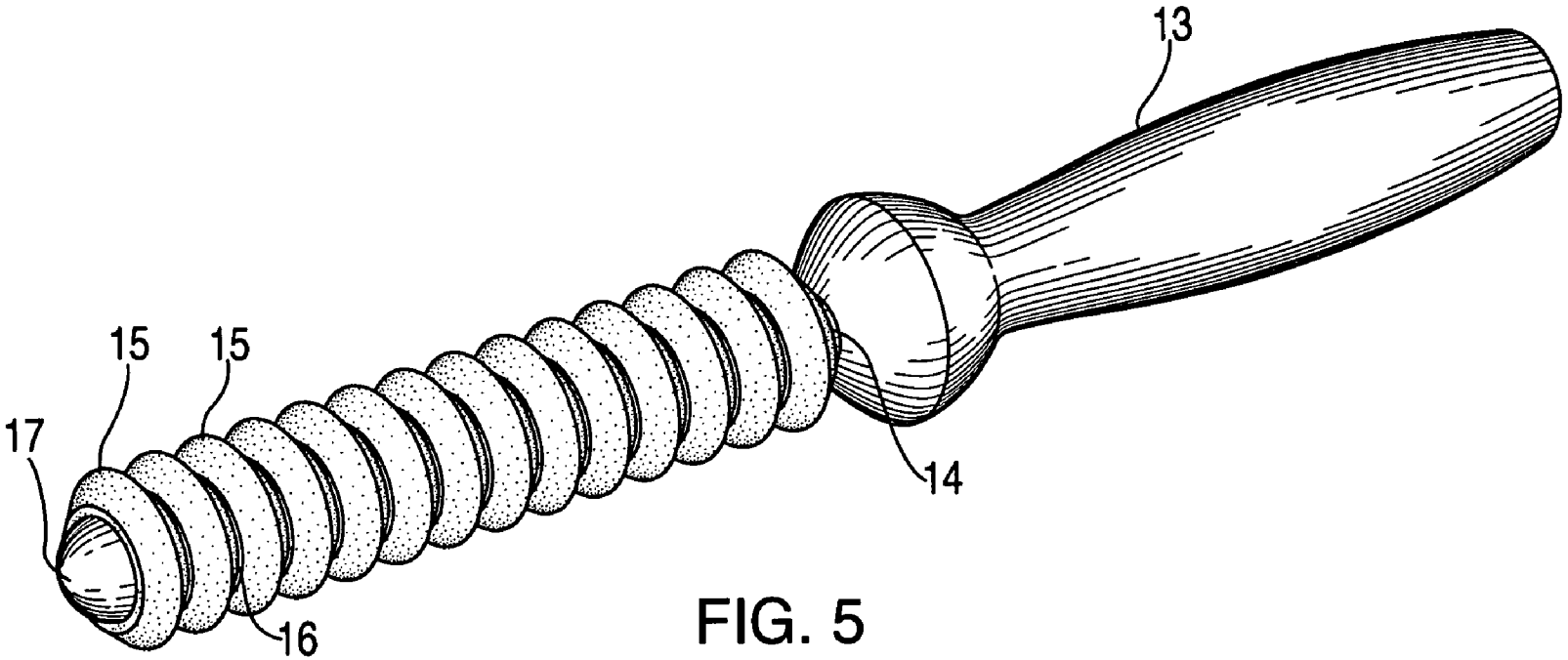
Figure 6:
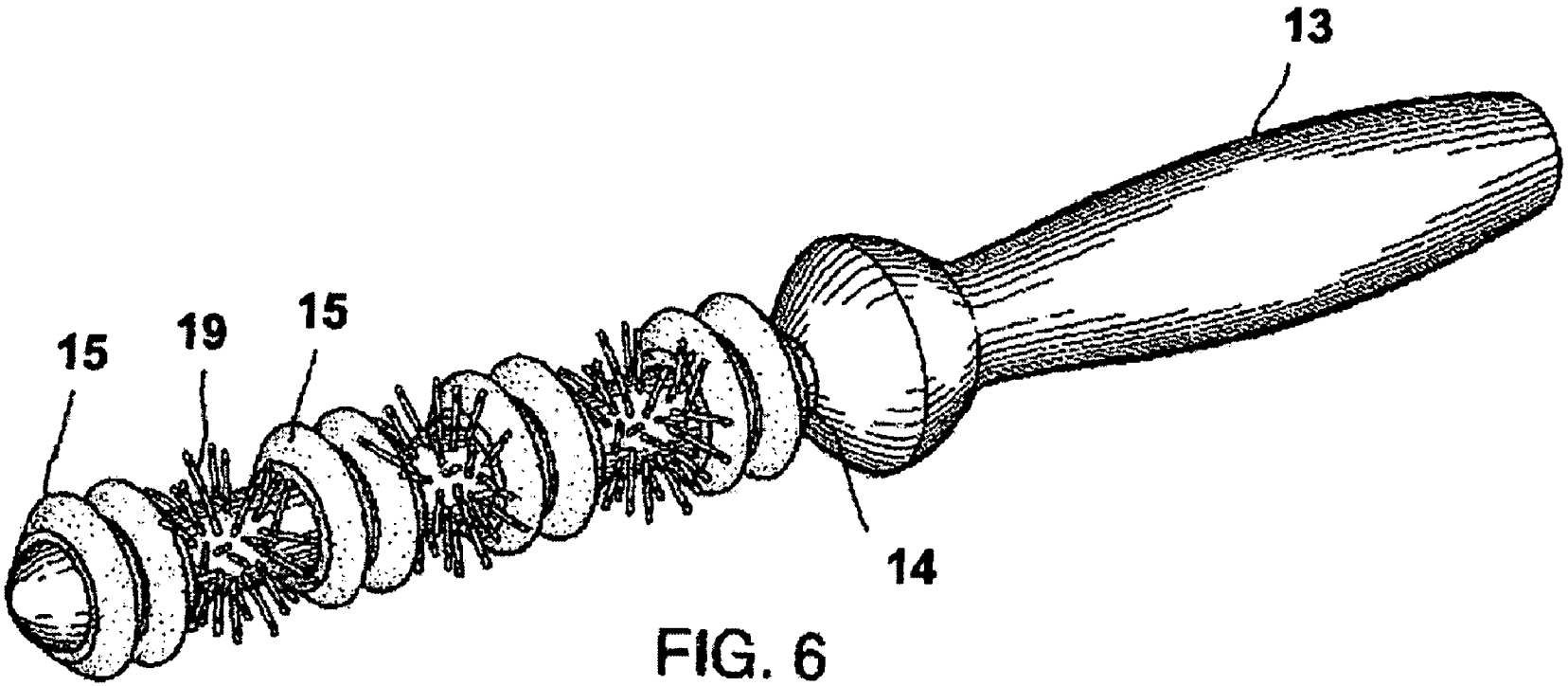
Figure 7:
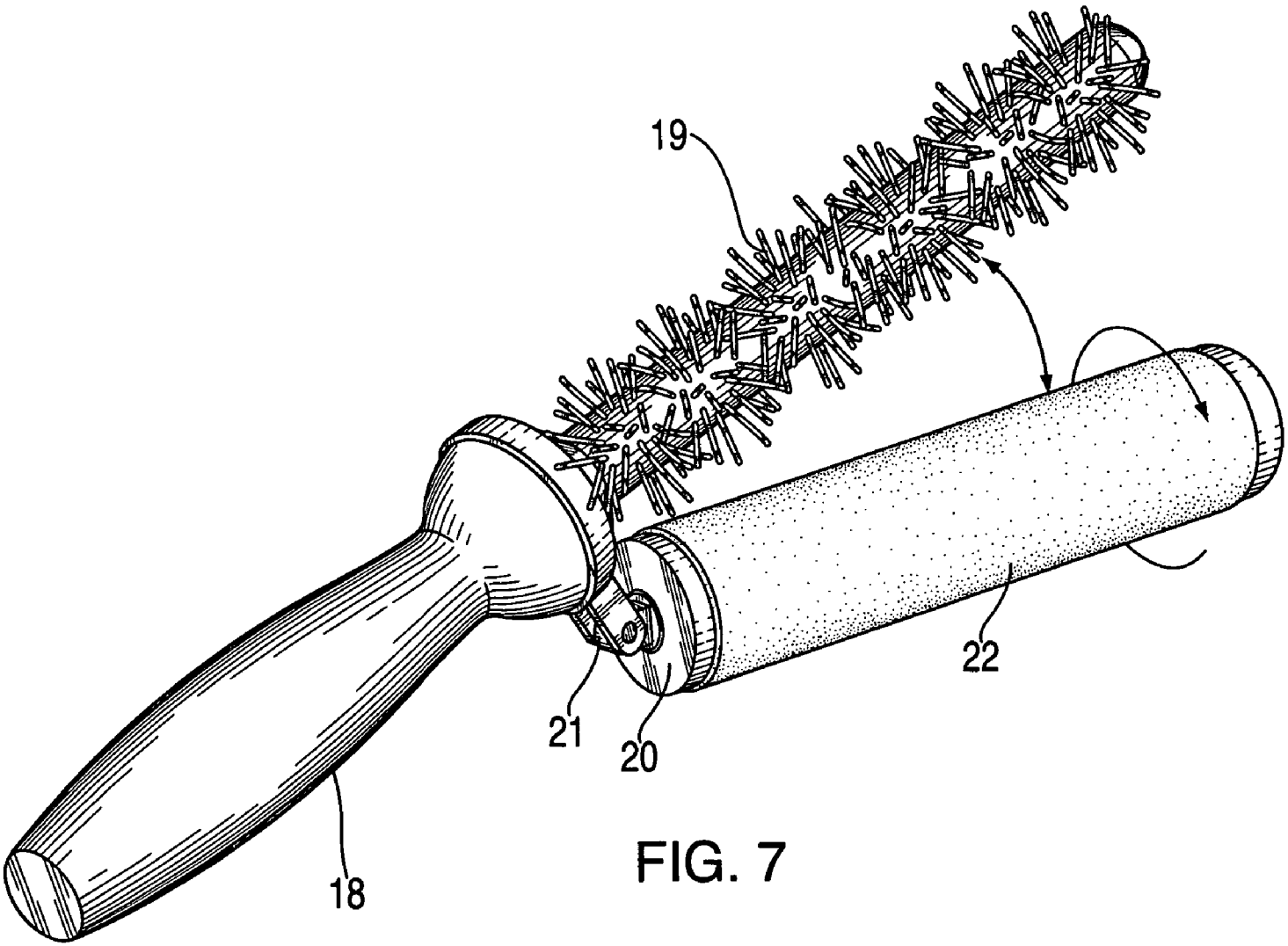

FIG. 2*a* is a perspective view of the underlying support employed in the embodiment of FIG. 2;

FIG. 3 is a plan view of the die-cut overlay of FIG. 2 prior to folding;

FIG. 4 is a plan view of an alternative unfolded die-cut overlay employable in the embodiment of FIG. 2;

FIG. 5 is a perspective view of another embodiment of the invention in which the material capable of absorbing water is in the shape of a molded disk, a plurality of the molded disks being mounted on a brush handle, each molded disk being shaped so that two adjacent disks form a V shaped groove between them which permits the hair to move over and between adjacent disks as the hair is brushed and dried with the implement;

FIG. 6 is a perspective view of an embodiment similar to that of FIG. 5 but with sections of molded disks alternating with sections of bristles; and FIG. 7 is a perspective view of a further embodiment of a brush upon which is mounted a pivotable roller fitted with a sleeve of the material able to absorb water.

DETAILED DESCRIPTION OF THE INVENTION

The implement of the present invention includes an element that is preferably comprised of at least 75%, more preferably at least 90% and most preferably is substantially completely comprised of a material that is able to absorb water by wicking or through capillary action and is sufficiently rigid to be free standing.

In one embodiment the implement of the present invention is a brush that has bristles that are comprised of a material that is able to absorb water by wicking or through capillary action and is sufficiently rigid to be free standing.

In another embodiment the implement of the present invention is a comb that has teeth that are comprised of a material that is able to absorb water by wicking or through capillary action and is sufficiently rigid to be free standing.

In further embodiments of the invention, the bristles or teeth as the case may be are comprised of at least 75% of such material.

In yet other embodiments of the invention, the bristles or teeth are comprised substantially entirely of such material.

By "substantially completely" is meant that the elements, the bristles or the teeth are comprised of at least about 98% of a material that is able to absorb water by wicking or through capillary action and is sufficiently rigid to be free standing.

In still other embodiments of the invention, the elements, the bristles, or the teeth are comprised entirely of such material.

Materials that are able to absorb water through wicking or capillary action that are utilizable in the production of the implements of the instant invention include for example:

- Polyurethane foams such as: Plei-Tech® (available from Pleiger Plastics) and Last-A-Foam® (available from General Plastics Manufacturing Co.)
- Nylon 6,6 membranes such as: MNY nylon filters (available from G.E.) and Bright Star Plus® nylon membranes (available from Ambion Co.)
- Polyether sulfones surface modified to possess nitro groups such as: Ultrason® E polyethersulfone (available from BASF) and Supor® polyethersulfone membrane filters (available from Pall Corp.)
- Dessicant materials such as
  - Montmorillonite clay (magnesium aluminum silicate of the sub-bentonite type)
  - Silica gel (silicon dioxide)
  - Silica gel or silicon dioxide washed with a concentration of colbalt chloride (this will indicate, by means of a color change, when the material is saturated), for example, Sorb-It® (available from Sud-Chemie)
  - Molecular sieves (porous crystalline aluminosilicates), such as Tri-Sorb® (available from United Dessicants) and SPI-Chem® (available from SPI Supplies and Structure Probe Inc.)
  - Calcium oxide (calcinated or recalcinated lime)
  - Calcium sulfate (created by the controlled dehydration of gypsum)
  - Activated alumina
- Wicking hydrophilic porous plastics from thermoplastic polymers such as:
  - High density polyethylene
  - Ultra-high molecular weight polyethylene
  - Polypropylene
  - and combinations thereof.

[These wicking hydrophilic porous plastics are available from M.A. Industries, Peachtree City, Ga.]

Figure 1:
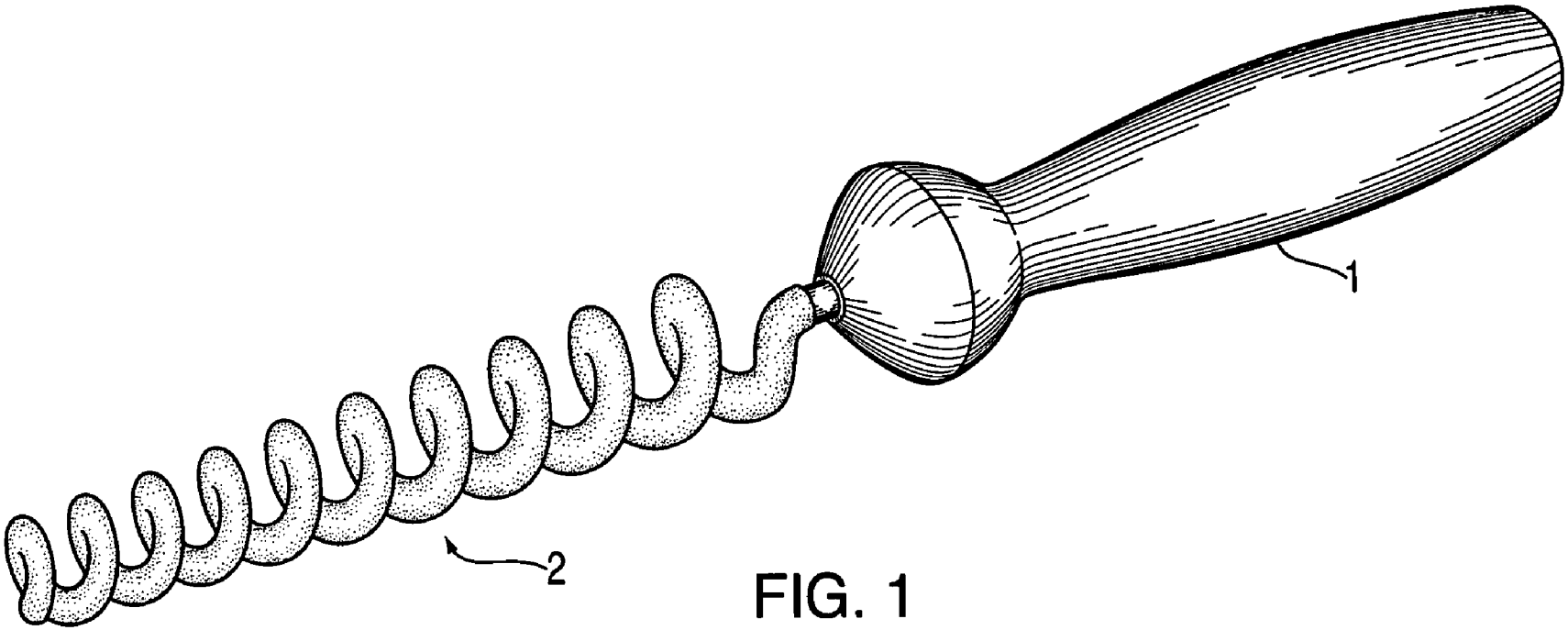
FIG. 1 is a perspective view of an embodiment of an implement, in accordance with the present invention, in which the material able to absorb water is coil-shaped to facilitate combing and drying of the hair.

Referring now to the accompanying drawings:

As is shown in the embodiment of FIG. 1, an implement for combing and drying hair, in accordance with the present invention, can be coil-shaped. Such an implement is comprised of a handle 1 and a coil 2 mounted on handle 1. In accordance with the present invention, coil 2 is made of the material capable of absorbing water. Alternatively, coil 1 can be a coil shaped stainless steel wire support encased within an outer sleeve of the material able to absorb water.

As is illustrated in the embodiment of FIG. 2, an implement for combing and drying hair can comprise a support having a handle 3 and a die-cut overlay 4 made of the material capable of absorbing water, which when folded over encases the support. The underlying support (as shown in FIG. 2*a*) is provided with pins 5*a*-5*f* adapted to engage corresponding openings 6*a*-6*f* in die-cut overlay 4 (as is more clearly shown in FIG. 3). Die-cut overlay 4 has a row of tooth-like projections 9 on one of its edges. Between that edge and edge 10 opposite it, die-cut overlay 4 contains a first fold/score line 8, a cut line 11 and a second discontinuous fold line 12. When die-cut overlay 4 is folded along line 8 and along line 12, a row of tooth-like projections 13 are exposed.

As shown in FIG. 2*a*, the support 3*a* can be shaped complementary to the shape of the folded die-cut overlay 4.

Instead of the triangular shaped support 3*a* of FIG. 2*a* one can employ a triangular shaped hairbrush sized so that the folded die-cut overlay 4 is held in place by the friction fit of the hairbrush encased within. In such embodiment, the end 10 of die-cut overlay 4 can be fixed to the opposing end of the folded die-cut overlay 4 by an adhesive strip (not shown) or, as shown in FIG. 4, by providing end 10 of overlay 4 with at least one tab 10*a*, and providing overlay 4 with at least one slot 10*b* adapted to receive tab 10*a* when overlay 4 is folded to encase the hairbrush.

In a further embodiment, illustrated by FIG. 5, handle 13 has a cylindrical extension 14. A plurality of disks 15 made of the material capable of absorbing water is mounted on extension 14 so that there is a space between adjacent disks 15. The faces of disks 15 may be shaped so that a V shaped groove 16 is defined by the face of one disk and the opposing face of the disk adjacent to it, such shaping facilitates combing and drying action. A cap 17 functions to lock the disks on extension 14.

In still another embodiment, illustrated by FIG. 6, handle 13 has cylindrical projection 14 upon which are mounted a plurality of disks 15 made of the material capable of absorbing water. Projection 14 has at least one section containing bristles 19 optionally and preferably made of the material capable of absorbing water, such section being located between one section of disks 15 and a second section of disks 15.

Referring now to the embodiment illustrated by FIG. 7, as is evident from such embodiment, the material able to absorb water by wicking or capillary action can be employed as a wiper for drying the hair as it is brushed. A hair brush having a handle 18 and a bristled extension 19 is fitted with a wiper roller 20 mounted on handle 18 by means of hinge 21 which permits the roller to be pivoted toward bristled extension 19 but not into contact with the bristles. Wiper roller 20 is rotatable about its vertical axis and is fitted with a sleeve 22 of the material able to absorb water. When damp hair is to be styled and dried, wiper roller 20 is pivoted toward the bristled extension 19 enabling the hair to be dried during brushing by sleeve 22 made of the material capable of absorbing water.

The following Example illustrates operation of an embodiment of the present invention, more particularly, the embodiment of FIG. 6, wherein the molded disks are comprised of a wicking hydrophilic porous polypropylene available from M.A. Industries (Peachtree City, Ga.).

EXAMPLE

Data was obtained through use of two procedures detailed below:

(i) Brush Soaking Procedure

A brush in accordance with the embodiment of FIG. 6 (wherein the molded disks were made of the wicking hydrophilic porous polypropylene from M.A. Industries, Peach City, Ga.) was tested. An otherwise identical brush, but without the molded disks 16, was also tested, as a control. Brush weight before exposure to water was determined. The brushes were placed in 500 ml beakers so that the bristles were entirely covered with distilled water. The beakers with the brushes were put on a New Brunswick Scientific C24 shaker (at 100 rpm and at ambient temperature) for 30 minutes. The brushes were weighed after 30 minutes and the amount of water and percent water absorption were calculated. The brushes were permitted to soak overnight at ambient conditions without shaking. Then the amount of water and percent water absorption were calculated. The test results are reported in Table 1 below.

TABLE 1

| Water Absorption Tests for Hydrophilic Porous Polypropylene Hair Brush | | | | |
|---|---|---|---|---|
| Original Wt. (g) | Wt. after 30 mins. (g)* | Water Absorbed (g) | Over Night Wt. (g) | Water Absorbed (g) |
| Hydrophilic Porous Polypropylene Hair Brush (Invention) | | | | |
| 190.43 | 212.78 | 22.35 | 222.60 | 32.17 |
| Control Hair Brush Only | | | | |
| 139.46 | 143.47 | 4.01 | 153.39 | 13.93 |

*Soak in 25° C. water. On shaker at 100 rpm for 30 minutes.

(ii) Brushing Real Hair Mannequin Head Procedure

A brush and control brush, as described in (i) above, were compared for water removal from a wet mannequin head. Brush weight before exposure to water was measured. The wet mannequin head was dried by brushing for 40 strokes. The brush weight after brushing was determined and the amount of water absorbed was calculated. The brushes were also dried at 40° C. for 3 hours and the amount of water pick up was calculated. The test results are reported in Table 2 below.

TABLE 2

| Water Absorption Tests for Hydrophilic Porous Polypropylene Hair Brush - Brush on Real Hair Mannequin Head | | | | | |
|---|---|---|---|---|---|
| Original Wt. (g) | Wt. after 40 times Brushing (g)* | Water Absorbed (g) | After Dry Wt. (g)** | Wt. Changes (g) | Water Absorbed (g) |
| Hydrophilic Porous Polypropylene Hair Brush (Invention) | | | | | |
| 195.20 | 200.06 | 4.86 | 194.90 | −0.30 | 5.16 |
| Control Hair Brush Only | | | | | |
| 142.17 | 145.01 | 2.84 | 142.88 | 0.71 | 2.13 |

*Brush the Real Hair Mannequin Head for 40 times
**Dry at 40° C. for 3 hours

As is evident from the data of Table 1, static determinations of water absorption by the brush in accordance with the embodiment of FIG. 6 show a five-fold increase in water absorption as compared to the control brush.

As is evident from the data of Table 2, the brush in accordance with the embodiment of FIG. 6 shows a two-fold increase in water absorption as compared to the control brush.

The dynamic measurement of water absorption is believed to be more relevant to actual consumer experience. The brush in accordance with the embodiment of FIG. 6 absorbed an amount of water sufficient to produce a consumer perceivable reduction in hair dry time.

What is claimed is:

1. In a hair styling implement having a plurality of teeth, or bristles, wherein the improvement comprises the teeth, or bristles, being comprised of a material that is capable of absorbing water through wicking or capillary action and is sufficiently rigid to pass through a tress of hair during styling;

an extension from a handle the extension comprising a plurality of disks, the teeth, or bristles, being provided between the disks; and a cap to lock the disks on the extension, wherein at least two disks are adjacently mounted on the extension, said disks comprising said material and being shaped so that a V groove is defined by the face of one disk and the opposing face of the disk adjacent to it, such shaping facilitating combing and drying action.

2. The implement as claimed in claim 1, wherein the material capable of absorbing water through wicking or capillary action is selected from the group consisting of polyurethane foams, nylon 6,6 membranes, polyether sulfone surface modified to possess nitro groups, sub-bentonite type magnesium aluminum silicate, silica gel, silica gel washed with a concentration of colbalt chloride, porous crystalline aluminosilicates, calcinated or recalcinated lime, calcium sulfate produced by the controlled dehydration of gypsum, activated alumina, and wicking hydrophilic porous plastics selected from the group consisting of high density polyethylene, ultra-high molecular weight polyethylene, and polypropylene, and combinations thereof.

3. The implement as claimed in claim 1 wherein the material is a wicking hydrophilic porous plastic selected from the group consisting of high density polyethylene, ultra-high molecular weight polyethylene, polypropylene, and any combinations thereof.

4. The implement as claimed in claim 1 wherein the extension is comprised of at least 75% of said material.

5. The implement as claimed in claim 1 wherein the extension is comprised of at least 90% of said material.

6. The implement as claimed in claim 1 wherein the extension is substantially completely comprised of said material.

7. In a hair styling implement having a plurality of teeth, or bristles, wherein the improvement comprises:

the teeth, or bristles, being comprised of a material that is capable of absorbing water though wicking or capillary action and is sufficiently rigid to pass through a tress of hair during styling; and an extension from a handle the extension comprising a plurality of disks, the teeth, or bristles, being provided between the disks, at least one of said disks being comprised of said material;

wherein the extension includes a first section of at least two disks adjacently mounted on the extension and a second section of at least two disks adjacently mounted on the extension, said disks comprising said material and being shaped so that a V groove is defined by the face of one disk and the opposing face of the disk adjacent to it, such shaping facilitating combing and drying action, and wherein the teeth, or bristles, being provided between the first and second disk sections.

8. The implement as claimed in claim 7 further comprising a cap to lock the disks on the extension.

9. The implement as claimed in claim 7, wherein the material capable of absorbing water through wicking or capillary action is selected from the group consisting of polyurethane foams, nylon 6,6 membranes, polyether sulfone surface modified to possess nitro groups, sub-bentonite type magnesium aluminum silicate, silica gel, silica gel washed with a concentration of colbalt chloride, porous crystalline aluminosilicates, calcinated or recalcinated lime, calcium sulfate produced by the controlled dehydration of gypsum, activated alumina, and wicking hydrophilic porous plastics selected from the group consisting of high density polyethylene, ultra-high molecular weight polyethylene, and polypropylene, and combinations thereof.

10. The implement as claimed in claim 7 wherein the material is a wicking hydrophilic porous plastic selected from the group consisting of high density polyethylene, ultra-high molecular weight polyethylene, polypropylene; and any combinations thereof.

11. The implement as claimed in claim 7 wherein the extension is comprised of at least 75% of said material.

12. The implement as claimed in claim 7 wherein the extension is comprised of at least 90% of said material.

13. The implement as claimed in claim 7 wherein the extension is substantially completely comprised of said material.

* * * * *